United States Patent [19]

Akers

[11] Patent Number: 4,911,094

[45] Date of Patent: Mar. 27, 1990

[54] POWERED FLOATER

[76] Inventor: William A. Akers, 297 Firehole Ave., West Yellowstone, Mont. 59758

[21] Appl. No.: 317,668

[22] Filed: Mar. 1, 1989

[51] Int. Cl.[4] ..... B63B 3/00

[52] U.S. Cl. ..... 114/346; 114/249; 441/40; 440/6

[58] Field of Search ..... 440/6, 7; 441/40, 41, 441/109, 129-132; 114/345, 346, 343, 242, 249, 251

[56] References Cited

U.S. PATENT DOCUMENTS

| | | | |
|---|---|---|---|
| 3,123,840 | 3/1964 | Cefalo, Jr. | 441/109 |
| 3,324,488 | 6/1967 | Schulz, Jr. | 114/346 |
| 3,665,534 | 5/1972 | McIntyre | 114/343 |
| 4,367,689 | 1/1983 | Lukehart et al. | 114/346 |

*Primary Examiner*—Sherman D. Basinger
*Assistant Examiner*—Jesus D. Sotelo
*Attorney, Agent, or Firm*—Richard C. Conover

[57] ABSTRACT

A float tube and a separate power unit floater combination wherein the power unit floater includes a toroidal shaped float tube and a power unit shaped to fit in a central cavity of the float tube. The power unit further includes a battery and electric motor for turning the propeller. A switchbox, used to control both the speed and direction of the propeller is placed forward on the fisherman's float tube at a location convenient for the fisherman to manipulate. The power unit being attached to the float tube behind the fisherman to allow the fisherman to have a clear area in front of him.

3 Claims, 1 Drawing Sheet

POWERED FLOATER

BACKGROUND OF THE INVENTION

This invention relates to a powered float tube for use by a sportsman. More particularly, it relates to a fisherman's float tube and separate floatable power unit combination. The power unit includes a battery and electric motor which are carried in a separate float tube. The power float tube is removably attached to the sportsman's float tube and furnishes the propulsion mechanism for this combination.

Fishermen have used buoyant float tubes for fishing for years. In these instances, a fisherman, usually wearing waders and swim fins, sits in the center of the toroidal shaped float tube and uses his swim fins to slowly propel the float tube backward; this can be tiring. To overcome this problem, float tubes have been developed which propel a sportsman by using power units formed integral with the float tube. For example, U.S. Pat. No. 3,324,488 to Schulz, Jr. illustrates an aquatic floater having a foam-filled shell and powered by an electric motor in front of an operator. The operator orients the electric motor in a direction he desires to travel and the electric motor pulls or pushes the float tube in the direction selected. However, this device cannot be used with conventional float tubes. Further, this device places the motor in front of a fisherman in an awkward spot for fishing. Further, the operator has to steer the device by orienting the motor in a desired direction of travel.

Portable boats which have removable motors are also known. U.S. Pat. No. 3,123,840 to Cefalo, Jr. illustrates an assembly for mounting an outboard motor in front of an operator using a detachable frame. Again, the motor is in an awkward location for a fisherman as it is directly in front of him. The operator controls the direction of travel by turning the motor relative to its mounting. This device cannot be used with a conventional fisherman's float tube.

There is a need for a power unit that is located behind a fisherman so that the area in front of him is clear for fishing. Since many fishermen have already made a substantial investment in float tubes for fishing, a need also exists for a separate power unit which can operate with a conventional fisherman's float tube and propel it in a direction the fisherman desires.

SUMMARY OF INVENTION

The present invention is directed to a float tube and a separate power unit floater combination. The power unit floater includes a toroidal shaped float tube and a power unit shaped to fit in a central cavity of the float tube. The power unit includes a battery and an electric motor for turning a propeller. A switch box, used to control both the speed and direction of the propeller, is placed forward on the fisherman's float tube at a location convenient for the fisherman to manipulate. The present invention provides a clear area in front of the fisherman thus allowing him to indulge in his sport unhampered by a motor in front of him. The power unit can be easily detached and the float tube used in a conventional fashion.

BRIEF DESCRIPTION OF THE DRAWINGS

In order that the invention may be clearly understood and readily carried into effect, a preferred embodiment of the invention will now be described, by way of example only, with reference to the accompanying drawings.

DESCRIPTION OF A PREFERRED EMBODIMENT

Figure 1:
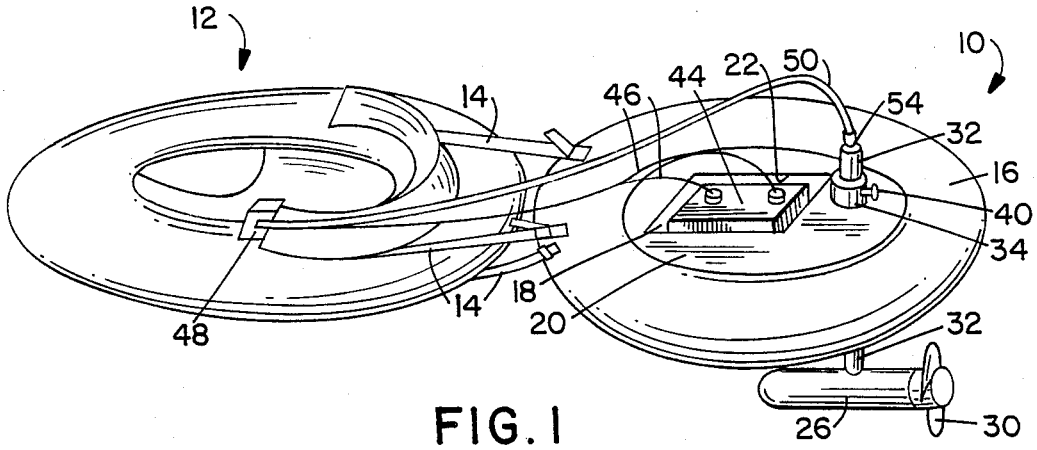
FIG. 1 is a perspective view of the power unit floater and fisherman's float tube combination.
Figure 2:
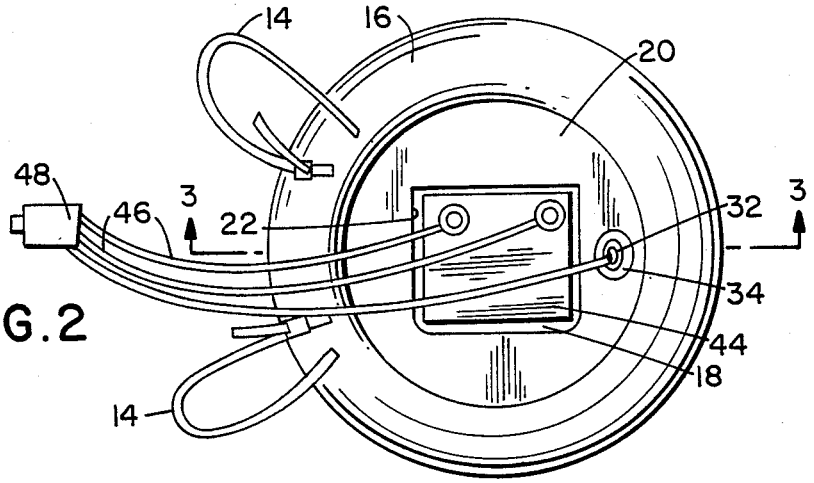
FIG. 2 is a top view of the power unit floater shown in FIG. 1.

A preferred embodiment of the present invention is shown in FIG. 1 where a power unit 10 is illustrated as strapped to a rearward end of a buoyant body member 12 which in a preferred embodiment is a conventional fisherman's float tube. This float tube has a webbed seat portion upon which a fisherman sits suspended in the water. In a preferred embodiment, the power unit 10 may be connected to the float tube 12 with connecting straps 14, however, other connectors such as a zipper may also be used.

Figure 3:
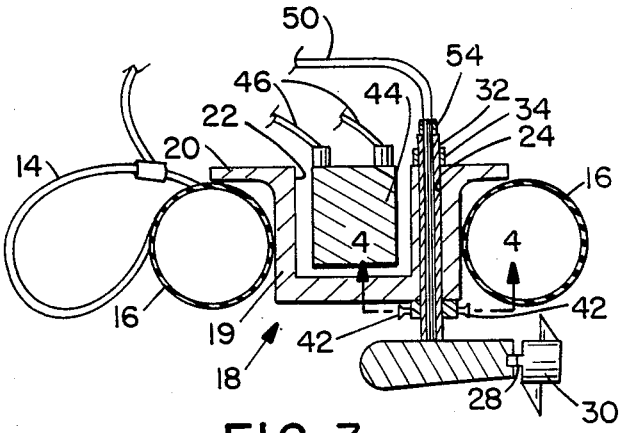
FIG. 3 is a sectional view taken along the line 3—3 of FIG. 2.

The power unit 10 includes a float tube 16 which accepts a power unit housing 18 in the central opening of the float tube 16. Power unit housing 18 includes a cylindrical portion 19 sized to fit the central opening of float tube 16 and a radially extending flange 20 which rests on the top surface of the float tube 16 as shown in FIG. 3. A battery compartment 22 having a closed bottom and an open top is formed within the power unit housing 18 for holding a battery 44 which, in a preferred embodiment, is a conventional 12-volt automobile battery.

A bore 24 is provided in power unit housing 18 which extends through the housing 18 and parallel with the longitudinal axis of the cylindrical portion of the housing as shown in FIG. 3.

An electric motor 26, as shown in FIG. 1, is furnished to propel the float tube. A motor shaft 28 connects the electric motor 26 with a propeller 30. The electric motor 26 is attached to a rigid, upright, conduit shaft 32 which extends through bore 24 of the power unit housing 18. The motor is prevented from dropping from the power unit housing 18 by collar 34 and set screw 40 as shown in FIG. 1.

Figure 4:
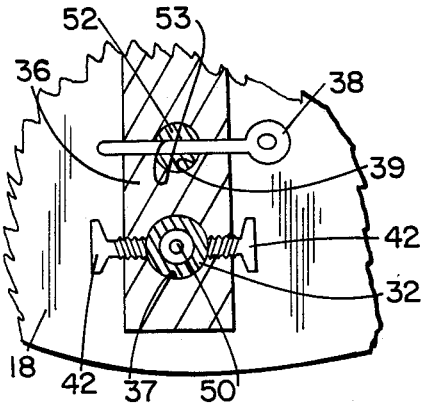
FIG. 4 is a detailed sectional view taken along the line 4—4 of FIG. 3.

An aligning boss 52 is integrally formed on the underside of power unit housing 18. This boss has a transverse bore 53 passing therethrough for receiving a motor mounting pin 38. A motor mounting block 36 includes a bore 37 for receiving shaft 32. Shaft 32 is secured to mounting block 36 with a pair of set screws 42 which extend through corresponding bores in block 36. Mounting block 36 includes a bore 39 for receiving boss 52 as shown in FIG. 4. The mounting block 36 is mounted to power unit housing 18 by inserting pin 38 through a corresponding bore in housing block 36 and bore 53 in boss 52.

The shaft 32 may be rotated with respect to motor mounting block by loosening screws 42 and rotating the shaft. The screws 42 may then be tightened to hold the motor in this position. This permits a user to trim the motor in such a way as to propel the float tube in a straight line.

A battery 44 is provided to furnish electrical energy to electrical motor 26. Battery cables 46 are routed to switch box 48 which is used to control the direction and speed of electric motor 26. In a preferred embodiment, there are four speeds rearward and two speeds forward available at switch box 48. A power cable 50 is routed from switch box 48, to electrical connector 54, which in a preferred embodiment is a male/female electrical connector normally used for car/trailer light hookups. The attaching shaft 32 includes appropriate wiring connecting connector 54 to the electric motor 26.

In operation a fisherman places attachment shaft 32 through bore 24 of power unit housing 18 and locks the drive means in position using collar 34 and set screw 40. On the bottom he locks the drive means in position using pin 38 extending through both motor mounting block 36 and boss 52 and then, after roughly aligning the electric motor 26, tightening adjusting screws 42 on attachment shaft 32.

Battery 44 is placed in battery compartment 22, and battery cables 46 are connected between switch box 48 and battery 44. Power cable 50 is connected between switch box 48 and electrical connector 54. The power unit float tube is connected to the fisherman's float tube by means of straps 14, and switch box 48 is then attached to the fisherman's float tube in a convenient position.

The fisherman uses the power unit to propel himself forward or backward by selecting one of 2 speeds forward or 4 speeds rearward available at switch box 48. Electrical energy from battery 44 is routed through switch box 48, power cable 50, to electric motor 26. After the float tube assembly is in motion, directional control is maintained by using swim fins or the orientation of the fisherman's feet. If the direction of travel is not in a straight line as desired, attachment shaft 32 can be rotated by loosening adjusting screws 42, rotating attachment shaft 32, and then retightening adjusting screws 42 to hold the attachment shaft 32 in a new orientation.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims:

I claim:

1. A powered floater, for propelling a person, comprising:

a buoyant body member having a forward end and a rearward end and further having a seat for supporting the person in a forward facing direction;

a toroidal shaped float tube surrounding a central opening, the float tube having a top and a bottom;

a connecting means for detachably connecting the float tube to the rearward end of the buoyant member in an abutting relation;

a drive means for propelling the float tube and being positioned under the bottom of the float tube;

the drive means including an electric motor powered by a battery, the electric motor being located within a motor housing and being connected to a propeller;

a rigid, upright conduit shaft having one end connected to the electric motor housing, the conduit shaft being adapted to carry electrical wiring from the battery to the motor;

a power unit housing having a top and a bottom and further having a cylindrical portion sized to slidably fit within the central opening of the float tube, the cylindrical portion having a radially extending flange being disposed on top of the float tube when the cylindrical portion is positioned within the central opening of the float tube, whereby the power unit housing may be floatably supported by the float tube;

the power unit housing further having a bore extending through the cylindrical portion in a direction parallel to the longitudinal axis of the cylindrical portion and aligned to receive the conduit shaft;

means for rigidly securing the conduit shaft in the bore; and the power unit housing further having a battery compartment having a closed bottom and an open top for receiving and supporting the battery.

2. A powered floater according to claim 1 further including means for adjustably locking the electrical motor and propeller in a predetermined direction of travel.

3. A powered floater as described in claim 1 further including an electrical control means electrically connected to the wiring between the battery and the electric motor, for controlling direction and speed of the electric motor.

* * * * *